US005820494A

United States Patent [19]

Gates et al.

[11] Patent Number: 5,820,494

[45] Date of Patent: Oct. 13, 1998

[54] BATTING CAGE FRAME

[76] Inventors: J. Rex Gates, deceased, late of Artesia, N. Mex.; by John A. Gates, executor, 5280 Bainbridge Dr., Boise, Id. 83703

[21] Appl. No.: 714,337

[22] Filed: Sep. 16, 1996

Related U.S. Application Data

[63] Continuation-in-part of Ser. No. 293,477, Aug. 22, 1994, abandoned.

[51] Int. Cl.[6] ..... A63B 69/40

[52] U.S. Cl. ..... 473/421; 135/120.2

[58] Field of Search ..... 473/429, 421, 473/213; 135/90, 91, 121, 97, 98, 96, 95, 1, 120.2, 87

[56] References Cited

U.S. PATENT DOCUMENTS

| | | | |
|---|---|---|---|
| 1,057,366 | 3/1913 | Vaniman | 135/97 |
| 1,350,289 | 8/1920 | Richards | 135/97 |
| 1,926,297 | 8/1933 | Cooper | 273/26 A |
| 2,126,102 | 8/1938 | Fowler | 273/26 A |
| 2,292,109 | 8/1942 | Engel | 273/26 A |
| 2,832,362 | 4/1958 | Critoph | 135/97 |
| 3,222,067 | 12/1965 | Litwhiler et al. | 273/26 |
| 3,447,549 | 6/1969 | Cunningham | 135/15 |
| 3,457,930 | 7/1969 | Gladden et al. | 135/119 |
| 3,593,997 | 7/1971 | Boehner | 273/26 |
| 3,604,944 | 9/1971 | Shepherd | 135/97 |
| 3,699,987 | 10/1972 | Hubble | 135/119 |
| 3,712,316 | 1/1973 | Leonard | 135/88.16 |
| 3,953,955 | 5/1976 | Huddle | 135/97 |
| 3,980,304 | 9/1976 | O'Niell et al. | 273/26 |
| 4,140,141 | 2/1979 | Marks | 135/4 |
| 4,462,631 | 7/1984 | Lange | 135/88.16 |
| 4,667,692 | 5/1987 | Tury | 135/139 |
| 4,815,736 | 3/1989 | Wright | 473/421 |
| 5,014,728 | 5/1991 | Arnold | 135/97 |
| 5,069,238 | 12/1991 | Marks | 135/109 |
| 5,649,559 | 7/1997 | Scott | 135/97 |

FOREIGN PATENT DOCUMENTS

| | | | |
|---|---|---|---|
| 990390 | 9/1951 | France | 135/1 |
| 1338345 | 8/1963 | France | 135/97 |

*Primary Examiner*—Theatrice Brown

*Attorney, Agent, or Firm*—H. Dennis Kelly; Jeffrey T. Hubbard; Timmons & Kelly

[57] ABSTRACT

A batting cage frame is constructed of two end subframes, each having a beam and two legs inclined with respect to the ground, and one midpoint subframe. The beam and legs of each subframe are composed of lengths of metal tubing held together with sleeve couplings and elbows. Edge cables for supporting an enclosure made of netting attach between eyebolts on the end subframes. The center section of each edge cable is a short length of chain that attaches to an eyebolt on the midpoint subframe. Each frame pivotably attaches to a foot that is secured to the ground with stakes. The end subframes incline away from each other. Anchor cables attached to the end subframes run down to a tie down ring. A tie down chain has a stake attached at each end. The tie down chain also attaches at its center to the tie down ring. Tension is created in the anchor cables and the edge cables by securing the stakes attached to the tie down chain into the ground. Tension in the anchor cables is adjustable to minimize sagging in the edge cables.

17 Claims, 5 Drawing Sheets

BATTING CAGE FRAME

BACKGROUND OF THE INVENTION

This application is a continuation-in-part of U.S. Ser. No. 08/293,477, filed Aug. 22, 1994, now abandoned.

1. Field of the Invention

This invention relates in general to frames for erected enclosures. In particular, the invention relates to frames for batting cages used in baseball for batting practice.

2. Description of the Related Art

The demand for baseball practice fields far exceeds the supply in most U.S. cities today. One solution to the problem has been the creation of multiuse city parks with temporary and portable baseball batting cages. This doubles the capacity of the existing baseball practice fields. Many individuals also practice batting in their backyards, and would desire a batting cage to prevent the loss of baseballs and the attendant risk of batted balls damaging property and neighbors. A batting cage that addresses both these needs would be welcome.

Batting cages for baseball practice are generally designed to enclose the batter and the pitcher, so that the baseballs are contained within the enclosure. The frame must suspend the enclosure and withstand bending forces created by wind loading. The conventional batting cage therefore has multiple steel frames embedded or inserted into concrete footings in the ground. It takes several days to dig the footings, mix and pour the concrete, wait for the concrete to cure, and erect the frames. This is a drawback for those who wish to relocate the batting cage, or to use it on a seasonal or other temporary basis. Although the steel frames can be removed with some designs, the concrete footings present a tripping hazard and generally interfere with using the area for other purposes after the baseball season. The typical frame also cannot be adjusted to compensate for sagging of the enclosure netting without creating undesirable bending stresses in the cantilevered frames.

U.S. Pat. No. 3,980,304, issued Sep. 14, 1976, to O'Neill et al., discloses a portable structure that remains permanently assembled and is transported on a commercial truck trailer. U.S. Pat. No. 4,815,736, issued Mar. 28, 1989, to Wright, discloses a structure made up of arcuate frame members that can be disassembled for transport. The frame members themselves are single pieces of substantial size, and would require a commercial truck trailer for transport.

A need remained for a structure that could be assembled by two people in an afternoon with only a few standard hand tools. A structure that disassembles into a small space, so that it could be transported in the bed of a standard pickup truck and could be stored in a relatively small volume was also desired. A structure that does not require parts permanently embedded in the ground, such as concrete footings, was also desired. Despite the lack of permanently installed parts, a structure that can withstand large wind loads while still being lightweight was also desired. In addition, a structure that allowed occasional readjustment to keep the enclosure ropes taut was also desired. Finally, a structure that can be manufactured economically enough to be used by individuals in backyards as well as by teams in parks was also desired.

SUMMARY OF THE INVENTION

The general object of the invention is to provide a frame for batting cage, without any part of the structure being permanently fixed in the ground. A coincidental object is that the frame should be capable of being completely assembled in an afternoon, and be able to be disassembled, transported, and reassembled easily. A third object is that the structure capable of being assembled without the use of any special tools or equipment. Another object is that the disassembled frame be lightweight and be capable of being transported in a small pickup truck, van or other noncommercial vehicle. A fifth object is that the structure be rugged and durable, and be capable of withstanding loading from strong winds. A final object of the invention is to allow adjustment of the frame to compensate for stretching and sagging of the enclosure over time.

In general, these objects are achieved by several interfitting sections of metal tubing that form a number of U-shaped subframes. The subframes attach to ground plates via pivoting connections, allowing the frame to be adjusted in place after initial erection. The pivoting nature of the frame allows tension in the enclosure ropes to be adjusted without creating undesirable bending stresses in the frame legs.

The above, as well as additional objects, features, and advantages of the invention will become apparent in the following detailed description and in the drawings.

DESCRIPTION OF THE PREFERRED EMBODIMENT

Figure 1:
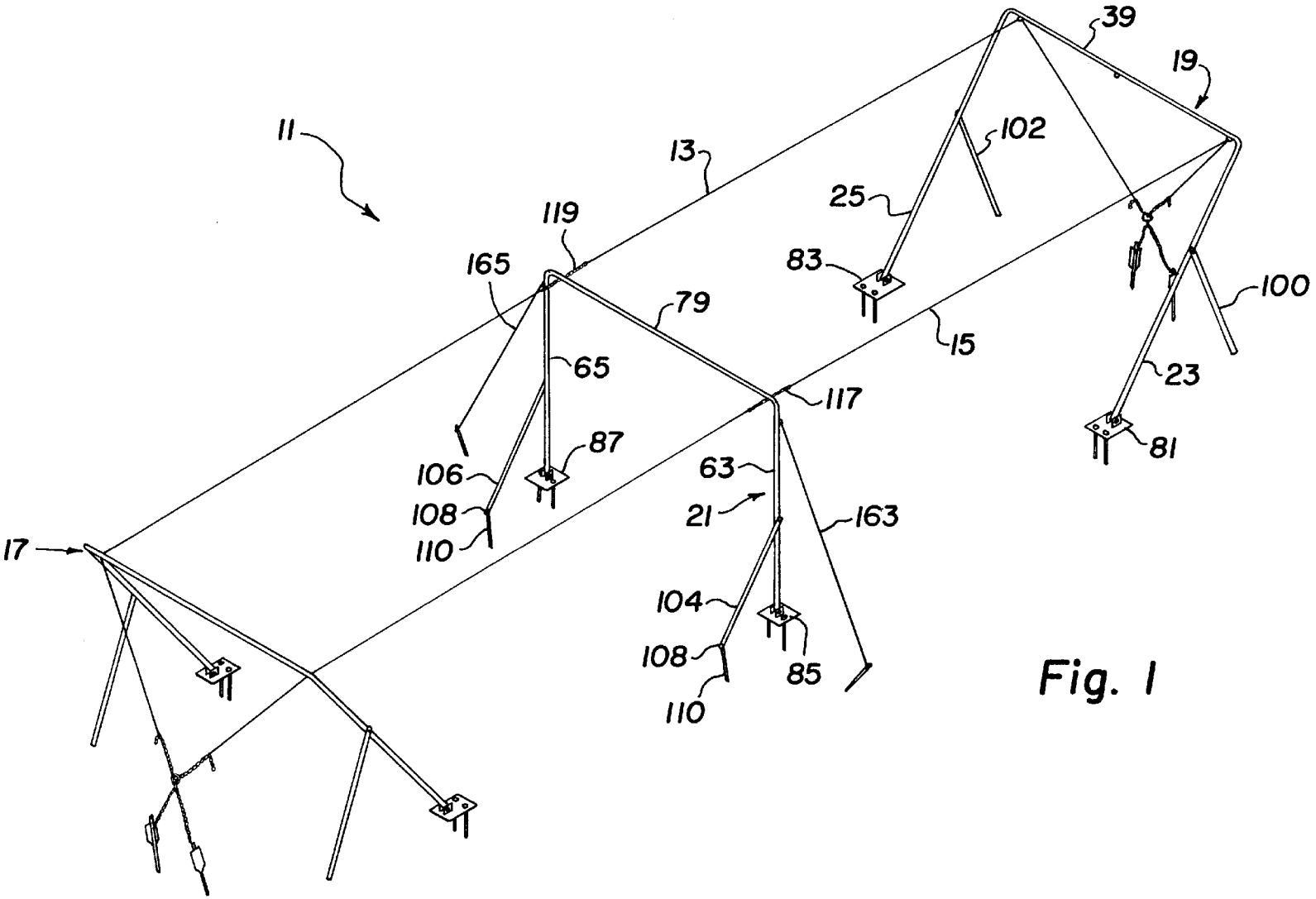
FIG. 1 is a perspective view of a batting cage frame according to the invention, as it appears when assembled, but without showing the enclosure.
Figure 2:
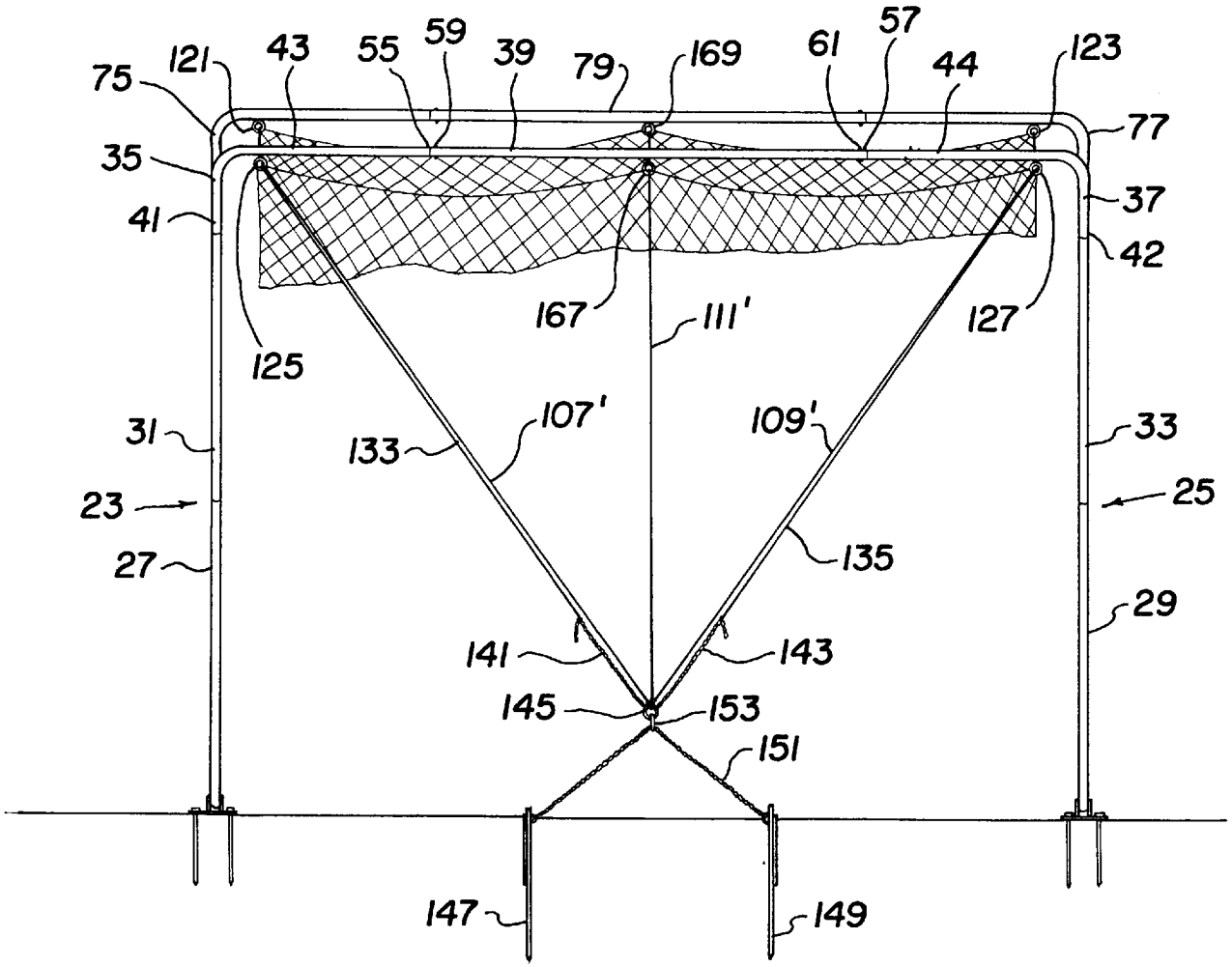
FIG. 2 is an end elevation thereof, without the mid frame guy ropes.
Figure 3:
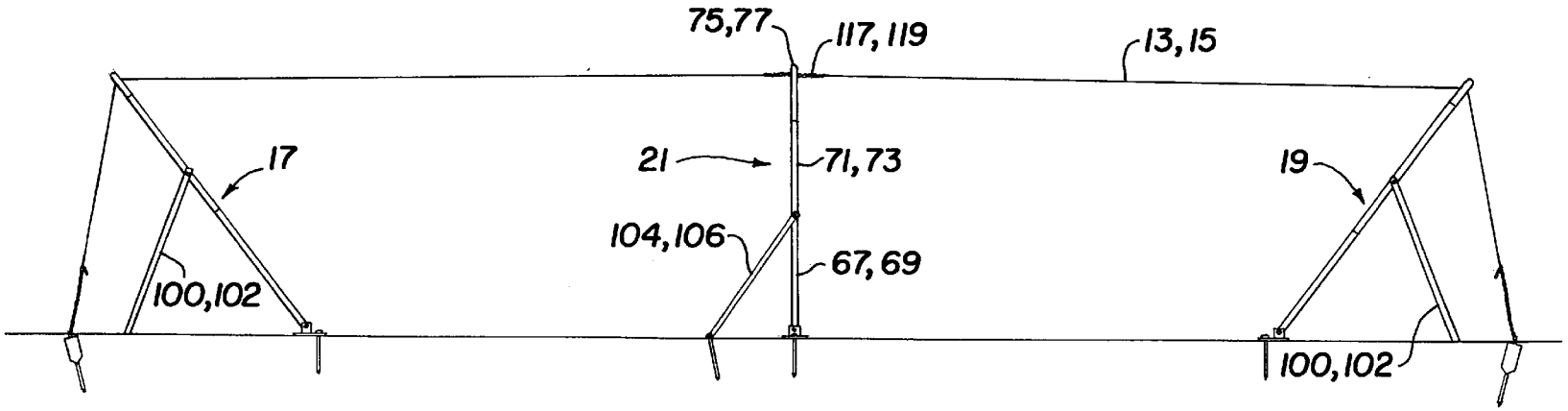
FIG. 3 is a side elevation thereof.

FIGS. 1–3 illustrate the preferred embodiment of a batting cage frame 11 of the invention as installed, showing the edge cables 13 and 15 used to support a batting cage enclosure, but without showing the enclosure itself. The enclosure is made of netting material that will stop and contain a hit baseball, while still allowing a substantially unobstructed view through the enclosure. Suitable materials include netting made of natural or synthetic fiber, but other materials can be used. The batting cage frame 11 includes two identical end subframes 17 and 19 and one midpoint subframe 21, hereinafter referred to simply as endframes and midframe.

As shown in FIGS. 1 and 2, each endframe 17 and 19 has two legs 23 and 25, each leg 23 and 25 being made of a seven foot (2134 millimeter) long lower leg 27 and 29 and a six foot (1830 mm) long upper leg 31 and 33. Elbows 35 and 37 attach to the upper legs 31 and 33. An eight foot (2440 mm) long end beam 39 attaches to and is upheld between the elbows 35 and 37. The leg elements 27, 29, 31, and 33, the elbows 35 and 37, and the beam 39 are each made of one and seven-eighths inch (47 mm) nominal diameter metal tubing, having inside diameter capable of admitting a one and five-eighths inch (41 mm) nominal diameter piece of tubing.

The elbows 35 and 37 are each made from a single piece of metal tubing or pipe, bent to form a curved, right-angle corner. The side sections 41 and 42, i.e. the sections of the elbows 35 and 37 that attach to the legs 23 and 25, extend about two feet (610 mm) from the centerline of the respective top sections 43 and 44. The top sections 43 and 44 extend about four feet (1219 mm) from the centerline of their respective side sections 41 and 42. The top sections 43 and 44 attach to the beam 39.

Figure 4:
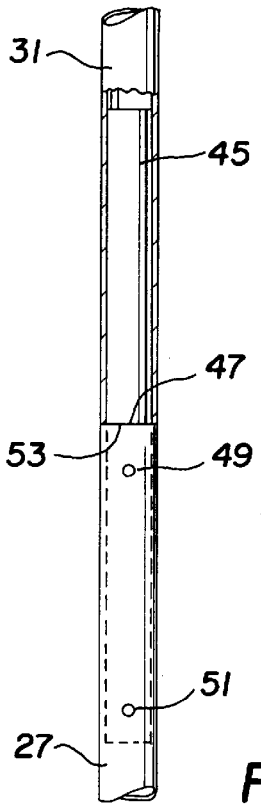
FIG. 4 is a partially cut-away side detail view of the construction of an end frame leg.

The technique for connecting each of the endframe lower legs 27 to its respective upper leg 31 is shown in FIG. 4, the same technique being used in both of the endframes 17 and 19 and the midframe 21. A pair of one-half inch (12 mm) holes 49 and 51 are drilled completely through each side of the lower leg 27. The holes 49 and 51 are located about two inches (51 mm) and ten inches (254 mm), respectively, from the top opening 47 of the lower leg 27. A two foot (610 mm) sleeve 45 of one and five-eighths inch (41 mm) nominal diameter tubing is inserted halfway into the top opening 47 of the lower leg 27. The lower leg 27 and the sleeve 45 are then welded together via the holes 49 and 51. During assembly, the upper leg 31 is then slid over the sleeve 45 until the bottom 53 of the upper leg 31 abuts the top 47 of the lower leg 27. The weight of the upper leg 31 holds it in place during use, so no lock pins or similar devices are required.

A technique similar to the one just described is also used for coupling the elbows 35 and 37 to the beam 39, the same technique being used in both of the endframes 17 and 19 and the midframe 21. A sleeve (not shown) is welded to one of the elbow top sections 43 and 44 in the same manner as described for the endframe lower leg 27. The elbows 35 and 37 and the beam 39 are slid together until the elbows 35 and 37 abut the beam 39, the pieces all lying within a single plane. As shown in FIG. 2, two holes 55 and 57 are then drilled completely through each side of the sleeve and the beam 39, one near each end of the beam 39. Each of the holes 55 and 57 is located about one inch (25 mm) from the end of the beam 39. Bolts 59 and 61 pass through each of the holes 55 and 57 and hold the pieces together when assembled.

Returning to FIGS. 1–3, the midframe 21 also has two legs 63 and 65, each leg 63 and 65 being made up of a six f00t (1830 mm) long lower leg 67 and 69, and a four-and-a-half foot (1372 mm) long upper leg 71 and 73. Midframe elbows 75 and 77, identical to those in the endframes 17 and 19, attach to the upper legs 71 and 73. A beam 79, identical to the ones in the endframes 17 and 19, is attached to and upheld between the elbows 71 and 73. The midframe 21 employs the same construction techniques and materials as those used in the endframes 17 and 19. The dimensions of each frame's major components may be varied for a particular use, but the length of any component should be limited so that the disassembled frame 11 can be transported in the bed of a small pickup truck.

Figure 5B:
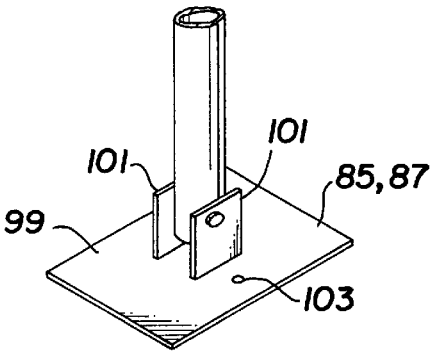
FIG. 5B is a perspective detail view of a mid frame base plate with a midframe leg attached thereto.
Figure 5A:
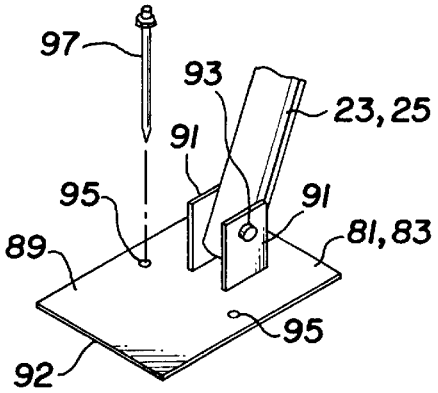
FIG. 5A is a perspective detail view of an end frame base plate with an end frame leg attached thereto.

FIG. 5A shows the details of the endframe feet 81 and 83 used to secure the legs 23 and 25 to the ground, while FIG. 5B shows the details of the midframe feet 85 and 87 used to secure the midframe legs 63 and 65 to the ground. Each of the endframe feet 81 and 83 consists of a rectangular base 89 made of steel plate and a pair of identical flanges 91 extending up from the base 89. The flanges 91 are parallel, oriented along the longer dimension of the base 89. The flanges 91 are offset from center along the longer dimension, so that one edge 92 of the base is farther from the flanges 91 than the other edges. The flanges 91 are also spaced apart so that one of the endframe lower legs 23 and 25 will fit between them without binding. Holes are drilled through the flanges 81 and the endframe lower legs 35 so that a bolt 93 can pass through and pivotably connect the pieces. The bolt 93 is loosely secured with a self-locking nut (not shown). The base 89 has a pair of identical holes 95, centered about the flanges 91. The holes 95 are configured to accept stakes 97 driven into the ground to secure the feet 81 and 83.

Each of the midframe feet 85 and 87 has a base 99, a pair of identical flanges 101, and a pair of identical holes 103 as in the case of the endframe feet 81 and 83, except for the locations of the flanges 101. In this case the flanges 101, like the holes 103, are centered on the base 99. This is because the loading force applied to each midframe foot 85 and 87 during use is substantially perpendicular to its base 99, while the loading force on each endframe foot 81 and 83 is oblique and directed generally toward the center point of the base 89.

As shown in FIG. 1, a pair of identical endframe braces 100 and 102 pivotably attach to and uphold the endframe legs 23 and 25 with self-locking nuts and bolts. The braces 100 and 102 are made of metal tubing. In a similar manner, midframe braces 104 and 106 are made of metal tubing, with one end formed into a foot 108 adapted to be secured to the ground with a stake 110. The midframe braces 104 and 106 pivotably attach to and uphold the midframe legs 63 and 65 with self-locking nuts and bolts. The braces 100, 102, 104, and 106 are not necessary when the frame 11 is assembled.

Figure 6:
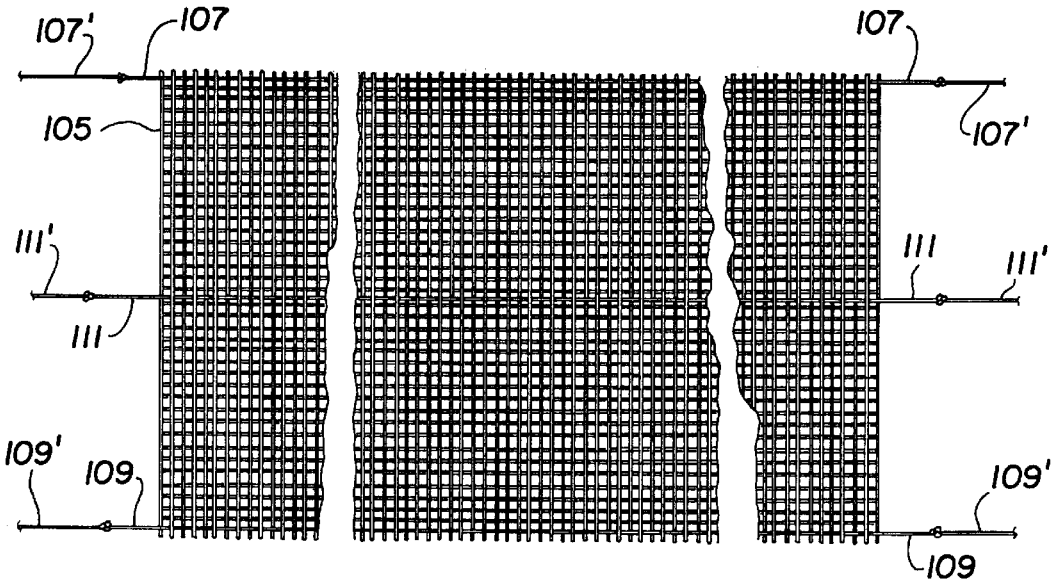
FIG. 6 is a detail top plan view of the ceiling section of the enclosure, showing the edge ropes and center rope.

FIG. 6 shows a typical example of the ceiling section 105 of an enclosure. The side wall sections of the enclosure are omitted from the figure, but are connected to the ceiling section 105 in one integral piece. The ceiling section 105 hangs beneath the edge cables 13 and 15 and the midframe beam 79 in the preferred embodiment.

The ceiling section 105 consists of netting with squares about one and three quarter inches (44 mm) on a side, although mesh shape and size can vary. Net edge ropes 107 and 109 and a center rope 111 are supplied with the ceiling section 105. The net edge ropes 107 and 109 and the center rope 111 can be made of natural or synthetic fibers. Extensions 107', 109', and 111' are tied onto the ends of the net edge ropes 107 and 109 and the center rope 111 for attachment to the anchoring system, to be discussed below.

Figure 7:
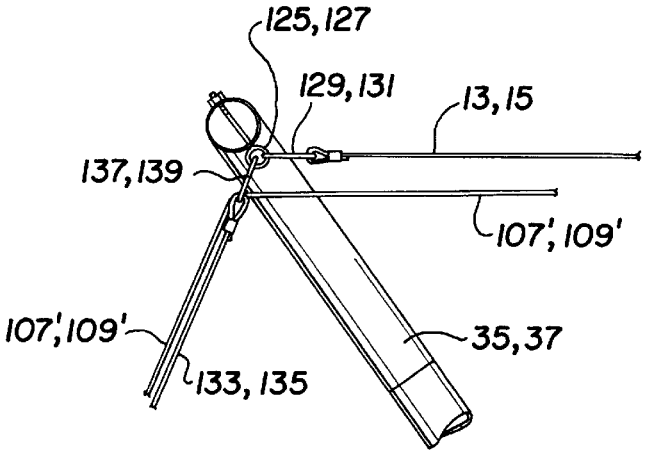
FIG. 7 is a partially cross-sectional detail view of a corner of an end frame of the batting cage frame, including cables and ropes attached thereto.

FIGS. 1, 2, and 7 show the way in which the edge cables 13 and 15 connect to the batting cage frame 11, and the means for maintaining tension in the edge cables 13 and 15. The edge cables 13 and 15 have center chain sections 117 and 119 about two feet (61 cm) long located in the center of the edge cables 13 and 15, at the point where the edge cables 13 and 15 pass under the midframe 21. The edge cable center chain sections 117 and 119 attach to eyebolts 121 and 123 on the midframe 21 with quick links (not shown). A quick link consists of a C-shaped metal loop, wherein the collinear ends of the C are threaded. A threaded fastener travels along the threaded portion of the ends so that the opening can be closed and reopened. Identical quick links are used throughout the frame 11 to fasten cable and chains together. Other suitable connectors can be used. The ends of the edge cables 13 and 15 attach to eyebolts 125 and 127 on the endframe beams 39 using quick links 129 and 131.

FIG. 7 shows a more detailed view of the arrangement around one of the endframe eyebolts 125, the arrangement around the other endframe eyebolt 127 being the mirror image of the described arrangement. Identical anchor cables 133 and 135 each attach at one end to an endframe eyebolt 125 and 127 with quick links 137 and 139. As shown in FIG. 2, the free ends of the anchor cables 133 and 135 each attach to identical anchor chains 141 and 143, that both attach in turn to a tie down ring 145. A pair of identical anchor stakes 147 and 149 attach to each end of a length of tie down chain 151 that in turn attaches to the tie down ring 145 via a quick link 153 that passes through the center link of the tie down chain 151. The stakes 147 and 149 are driven into the ground so that the chains 141, 143, and 151 roughly form a letter 'X', although the angles formed between adjacent legs need not be equal.

The 'X' configuration just described addresses a problem associated with using a single stake for anchoring the tie down ring 145. The stakes 147 and 149 can be located under the endframe beam 39 to reduce the space taken up by the frame 11. This is desirable when erecting the frame 11 in small backyards. Using this configuration, the tie down chain 151 lies within a substantially vertical plane. When a single stake is used, the tie down chain 151 is essentially vertical. Tension in the tie down chain 151 is therefore also essentially vertical, and acts to pull the stake out of the ground. By using two stakes 147 and 149 set far apart, the tie down chain 151 and the resulting tension are inclined away from vertical, reducing the tendency for the stakes 147 and 149 to be pulled out of the ground.

Figure 8:
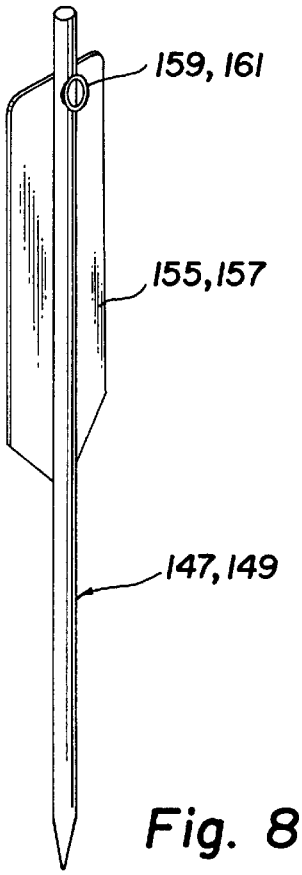
FIG. 8 is a perspective detail view of the grounding stakes used with the batting cage frame.

To stabilize the stakes 147 and 149 further, vanes 155 and 157 are welded to the stakes 147 and 149 as shown in FIG. 8. The vanes 155 and 157 are oriented substantially perpendicular to the plane containing the tie down chain 151 when the stakes 147 and 149 are driven into the ground. The tie down chain 151 connects to eyebolts 159 and 161 welded on the stakes 147 and 149.

The batting cage frame 11 is assembled essentially according to the following procedure, wherein the major steps are numbered:

1) The endframe feet 81 and 83 and the midframe feet 85 and 87 are laid out on the ground using the following method:

a) The edge cables 13 and 15 are laid out straight and parallel, sixteen feet (488 cm) apart, and staked down temporarily.

b) The second edge cable 15 is adjusted as needed so that the ends of the edge cables 13 and 15 are square, i.e. a line connecting the adjacent ends of the edge cables 13 and 15 is perpendicular to the edge cables 13 and 15. A simple way to achieve this is to employ the 3:4:5 relative side length relationship of a right triangle, with the sixteen foot (488 cm) separation being the side of relative length 4. A point twelve feet (366 cm) from the end of the first edge cable 13 is marked off, and the second edge cable 15 is adjusted as needed until the end of the second edge cable 15 is twenty feet (610 cm) from the marked point on the first edge cable 13, while maintaining the sixteen foot (488 cm) separation between the edge cables 13 and 15.

c) The endframe feet 81 and 83 are placed under the edge cables 13 and 15, and secured to the ground with stakes 97, with the foot flanges 91 located eight feet six inches (259 cm) from the ends of the edge cables 13 and 15. The feet 81 and 83 are oriented with the distal base edges 92 facing toward each other. The midframe feet 85 and 87 are then centered under the edge cable center chain sections 117 and 119 and secured to the ground with stakes 97.

2) The center of the tie down chain 151 is attached to the tie down ring 145 with the quick link 153. The anchor stakes 147 and 149 are attached to the tie down chain 151, and driven into the ground about three feet, six inches (107 cm) apart and centered between the ends of the edge cables 13 and 15.

3) The endframes 17 and 19 are assembled, starting with one foot 81 and working along the endframe 17 and 19 from the first lower leg 27 to the adjacent upper leg 31, the first elbow 35, the beam 39, the second elbow 37, the second upper leg 33, the second lower leg 29, and finally to the other foot 83. The legs 23 and 25 attach to the feet 81 and 83 using one-half inch (12.7 mm) diameter bolts and self-locking nuts employing nylon inserts, leaving the legs 23 and 25 free to pivot. The subframes 17 and 19 are laid on the ground. At least one of the endframes should lie with the beam 39 lying toward the midframe 21, for reasons that will become evident later in the assembly procedure.

4) The midframe 21 is assembled in the same manner as that just described for assembling the endframes 17 and 19.

5) The endframe braces 100 and 102 are attached to the outside of the endframe legs 23 and 25. The midframe braces 108 and 110 are likewise attached to the outside of the midframe legs 63 and 65.

6) The midframe is raised to a vertical position and the midframe braces 104 and 106 secured to the ground with identical stakes 110. The midframe braces 104 and 106 are only necessary for upholding the midframe 21 during assembly. Once the frame 11 is fully assembled, the braces 104 and 106 can be removed, although it is suggested that they remain in place, for use in disassembly of the frame 11.

7) The temporary stakes holding down the edge cables 13 and 15 are removed, and the edge cables 13 and 15 are attached to the endframe eyebolts 125 and 127 with quick links 129 and 131. As already discussed, at least one of the endframes 17 and 19 must be oriented with the beam 39 toward the midframe 21, or the edge cables 13 and 15 will not reach between the endframes 17 and 19 while they are resting on the ground. The anchor cables 133 and 135 are attached to the endframe eyebolts 125 and 127 with quick links 137 and 139.

8) The first endframe 17 is raised up and away from the midframe 21, so that the beam 39 is about twelve feet (366 cm) from the ground. The endframe braces 100 and 102 are propped up to hold the endframe 17 in place. The anchor chains 141 and 143 are connected to the tie down ring 145, and the anchor cables 133 and 135 are attached to the anchor chains 141 and 143 using quick links 144 and 146. Tension in the anchor cables 133 and 135 can then be adjusted by connecting the quick links on the anchor cables 133 and 135 to different links on the anchor chains 141 and 143 until slack is just eliminated.

9) The second endframe 19 is raised up and away from the midframe 21, and the immediately preceding step is repeated, except that in this case the tension is adjusted to remove most of the sag in the edge cables 13 and 15. The endframe braces 100 and 102 should not be bearing any load following this step: if so, they should be adjusted to remove any loading. When this step is completed, the second endframe beam 39 should be within a foot (30 cm) of twelve feet (366 cm) from the ground. If not, it is suggested that the second endframe 19 be laid back down on the ground, and the endframe feet 81 and 83 be relocated as needed.

10) The edge cable center chain sections 117 and 119 are connected to the midframe eyebolts 121 and 123 using quick links.

11) Guy ropes 159 and 161 are attached to the midframe 21 and staked down.

12) The net (not shown) is laid out on the ground below the frame 11. The corners at one end of the net are attached to the edge cables 13 and 15 about three feet (91 cm) from the nearest of the two endframes 17 and 19 with quick links. The net edge rope extensions 107' and 109' are directed through the quick links 137 and 139 holding the anchor cables 133 and 135, and tied onto the tie down ring 145. Although the quick links 137 and 139 provide the means for directing the net edge ropes 107' and 109' past the endframe beams 39, the eyebolts 125 and 127 can also be used.

13) The net is then attached to the edge cables 13 and 15 at roughly eight foot (244 cm) intervals using quick links, starting from one end of the net and proceeding to the opposite end. The net edge rope extensions 107' and 109' at each end are then directed through their respective quick links 137 and 139, and tied onto the tie down ring 145. Tension in the net edge ropes 107 and 109 is manually adjusted as the ropes are tied down.

14) The ends of the net center rope extensions 111' are passed through eyebolts 167 in the center of each of the endframe beams 39 and are tied onto their respective tie down rings 145. The center rope 111 is attached to an eyebolt 169 in the center of the midframe beam 79 with a quick link. Tension in the center rope 111 is then readjusted manually, just as with the net edge ropes 107 and 109.

When the frame is assembled, the endframe legs 23 and 25 will incline at about a fifty-three degree angle with respect to the ground, so that the endframe feet 81 and 83 are closer to their mirror images than the endframe beams 39. Because the endframe legs 23 and 25 angle outward, the anchoring cables 133 and 135 can be oriented straight down from the endframe beams 39 when space is limited, as in backyards.

The batting cage frame of the invention has several advantages over the prior art. The batting cage frame can be assembled in an afternoon by two people, instead of three to four days for the typical fixed location batting cage that requires concrete footings. The frame can be disassembled, easily transported and quickly reconstructed using only a few simple tools. The subframes pivot to relieve bending stresses due to wind loading, and the entire frame can be adjusted to remove slack in the enclosure lines if the lines sag or stretch. The batting cage frame is extremely rugged and durable. It has no complicated moving parts, can be easily installed and removed, and does not leave permanent fixtures in the ground once it is removed.

The invention has been shown in only one embodiment. It should be apparent to those skilled in the art that the invention is not so limited, but is susceptible to various changes and modifications without departing from the spirit of the invention.

What is claimed is:

1. A batting cage frame for supporting an enclosure having a ceiling section made of a flexible material, the ceiling section having a pair of net edge ropes and a center rope, wherein the frame comprises:

a plurality of feet;

a pair of end subframes pivotably attached to the feet and oriented obliquely to horizontal, wherein each end subframe comprises at least two legs having lower ends and upper ends, a beam removably attached to the upper ends of the legs and the feet being attached to the lower ends of the legs, and means at selected locations of the end subframes far receiving the net edge ropes and the center rope of the enclosure;

a midpoint subframe, the midpoint subframe comprising two legs having lower ends and upper ends, a midpoint subframe beam removably attached to the upper ends of the legs, and means for connecting the edge cables and the center rope to the midpoint subframe;

a plurality of edge cables removably attached to the end subframes; and tensioning means, removably attached to the edge cables.

2. A batting cage frame as recited in claim 1, wherein the means at selected locations comprise a plurality of eyebolts extending from the end subframe beam, and the connecting means of the midpoint subframe comprises a plurality of eyebolts extending from the midpoint subframe beam.

3. A batting cage frame as recited in claim 2, wherein the tensioning means includes a tie down ring, anchor cables attached to the eyebolts, anchor chains attached between the anchor cables and the tie down ring, a tie down chain, and tie down stakes attached to the tied down chain.

4. A batting cage frame as recited in claim 3, further comprising adjusting means for varying the tension in the anchor cables, the adjusting means further comprising a fastener for attaching one end of the anchor cable to the eyebolt and its other end at different locations on an anchor chain, so as to change the effective length of the anchor chain.

5. A batting cage frame as recited in claim 3, wherein the net edge ropes and the center rope of the enclosure attach to the tie down rings.

6. A batting cage frame as recited in claim 2, wherein the means at selected locations is a plurality of quick links connected to the eyebolts extending from the end subframe beams.

7. A batting cage frame as recited in claim 1, wherein the legs on the end frame are angled outward when erected.

8. A batting cage frame as recited in claim 1, further comprising midpoint subframe feet pivotably attached to the midpoint subframe legs.

9. A batting cage frame for supporting an enclosure having a ceiling section made of netting, the ceiling section having a pair of net edge ropes and a center rope, wherein the frame comprises:

a plurality of feet;

a pair of end subframes oriented obliquely to horizontal, each end subframe comprising at least two legs having lower ends and upper ends, the feet being attached to the lower end of the legs, a beam removably attached to the upper ends of the legs, and a plurality of eyebolts attached to the beam at selected locations and receiving the edge ropes and the center rope;

a plurality of edge cables removably attached to the eyebolts;

a tie down ring;

anchor cables attached to the eyebolts;

anchor chains attached between the anchor cables and the tie down ring;

a tie down chain; and tie down stakes attached to the tie down chain.

10. A batting cage frame as recited in claim 9, further comprising a midpoint subframe, wherein the midpoint subframe comprises two legs having lower ends and upper ends, a midpoint subframe beam removably attached to the upper ends of the legs, and means for connecting the edge ropes and the center rope to the midpoint subframe.

11. A batting cage frame as recited in claim 10, wherein the midpoint subframe connecting means comprises a plurality of eyebolts extending from the midpoint subframe beam.

12. A batting cage frame as recited in claim 10, further comprising midpoint subframe feet pivotably attached to the midpoint subframe legs.

13. A batting cage frame as recited in claim 9, further comprising a pair of quick links for attaching the anchor cable to different locations on the anchor chain, so as to change the effective length of the anchor chain.

14. A batting cage frame as recited in claim 9, further comprising extension ropes attached to the net edge ropes and the center ropes, the net edge ropes and the center rope being attached to the tie down rings via the extension ropes.

15. A batting cage frame as recited in claim 9, further comprising a plurality of quick links connected to the eyebolts extending from the end subframe beams at selected locations, the edge and center ropes extending through the quick links.

16. A batting cage frame for supporting an enclosure having a ceiling section made of a flexible material, the ceiling section having a pair of net edge ropes and a center rope, wherein the frame comprises:

a plurality of feet;

a pair of end subframes and a midpoint subframe, each end subframe comprising at least two legs having lower ends and upper ends, the feet being attached to the lower ends, a beam removably attached to the upper ends of the legs, and means at selected locations on the subframes receiving the net edge ropes and the center rope of the enclosure the receiving means comprising a plurality of eyebolts extending from the end subframe beam, and the connecting means on the midpoint subframe comprises a plurality of eyebolts extending from the midpoint subframe beam;

a plurality of anchor cables removably attached to the end subframes;

tensioning means, removably attached to the end subframes, for maintaining tension in the edge cables, the tensioning means comprising a tie down ring, anchor cables attached to the eyebolts, anchor chains attached between the anchor cables and the tie down ring, a tie down chain, and tie down stakes attached to the tied down chain.

17. A batting cage frame as recited in claim 16, further comprising adjusting means for varying the tension in the edge cables, the adjusting means comprising a fastener for attaching an end of the anchor cable to the eyebolt to different locations on an anchor chain, so as to change the effective length of the anchor chain.

* * * * *